US008117774B2

(12) United States Patent
Meltzer

(10) Patent No.: US 8,117,774 B2
(45) Date of Patent: Feb. 21, 2012

(54) HANGING FILE FOLDER HAVING FOLD-UP LABEL FEATURES

(75) Inventor: Donald Meltzer, Aurora, CO (US)

(73) Assignee: American Pad & Paper LLC, Richardson, TX (US)

( * ) Notice: Subject to any disclaimer, the term of this patent is extended or adjusted under 35 U.S.C. 154(b) by 0 days.

(21) Appl. No.: 12/689,651

(22) Filed: Jan. 19, 2010

(65) Prior Publication Data

US 2011/0173855 A1 Jul. 21, 2011

(51) Int. Cl.
*B42F 21/00* (2006.01)

(52) U.S. Cl. ..... 40/359; 40/641; 229/67.2

(58) Field of Classification Search ..... 40/359, 40/360, 641, 124.19; 229/67.2, 67.1; 283/31, 283/37

See application file for complete search history.

(56) References Cited

U.S. PATENT DOCUMENTS

| | | | | | |
|---|---|---|---|---|---|
| 1,048,577 | A | * | 12/1912 | Pardoe, Jr. | 40/359 |
| 2,300,623 | A | * | 11/1942 | Hornung | 40/360 |
| 3,123,207 | A | * | 3/1964 | Goldstein | 206/763 |
| 3,683,533 | A | * | 8/1972 | Kelly | 40/359 |
| 4,109,850 | A | * | 8/1978 | Meenan et al. | 229/72 |
| 4,184,699 | A | | 1/1980 | Lowe, Jr. | |
| 5,407,230 | A | * | 4/1995 | Brink et al. | 281/15.1 |
| 5,447,334 | A | | 9/1995 | Hartsock | |
| 5,503,487 | A | | 4/1996 | Ong | |
| 5,540,513 | A | | 7/1996 | Wyant | |
| 5,639,124 | A | * | 6/1997 | Jung | 283/36 |
| 5,909,979 | A | | 6/1999 | Winzen | |
| 5,996,130 | A | | 12/1999 | Verhines | |
| 5,996,881 | A | * | 12/1999 | Smith | 229/67.1 |
| 6,039,354 | A | | 3/2000 | Mangler | |
| 6,328,338 | B1 | | 12/2001 | Sherman et al. | |
| 6,375,604 | B1 | | 4/2002 | Verhines | |
| 6,732,461 | B2 | | 5/2004 | Slattery et al. | |
| 7,305,784 | B2 | | 12/2007 | Black | |
| 2005/0257408 | A1 | * | 11/2005 | Black | 40/641 |
| 2007/0119082 | A1 | | 5/2007 | Gilchrist | |
| 2008/0030016 | A1 | | 2/2008 | Black et al. | |
| 2010/0183358 | A1 | * | 7/2010 | Kelley | 402/79 |

* cited by examiner

*Primary Examiner* — Joanne Silbermann
*Assistant Examiner* — Kristina N Junge
(74) *Attorney, Agent, or Firm* — Gardere Wynne Sewell LLP

(57) ABSTRACT

A hanging file folder having fold-up label features can be comprised of a sheet of flat, foldable material having two doubled over ends. A first hanger member can be disposed within one of the doubled over ends and configured to couple to a hanging file drawer rail. A second hanger member can be disposed within the other of the doubled over ends and configured to couple to the hanging file drawer rail. A plurality of tab members formed of the flat, foldable material can be attached to at least one of the doubled-over ends and have pairs of ears extending to the sides of the tab members. The tab members can be positioned to be extended beyond an edge of the doubled over end to which they are attached by folding the tab members and inserting the ears into pairs of slots formed in the doubled over ends.

24 Claims, 14 Drawing Sheets

FIG. 16

FIG. 17

HANGING FILE FOLDER HAVING FOLD-UP LABEL FEATURES

BACKGROUND

Hanging file folders typically have tab members to identify the contents of the folders. These tab members need to be staggered in placement to permit ease of viewing of the tabs. Rather than providing sets of file folders having fixed position tab members in staggered formation, a common practice to is to provide slots into which detached, repositionable tab members can be positioned as desired by end users. An example disclosure of these types of tab members can be found in U.S. Pat. No. 5,503,487.

Such repositionable tab members have proven less than ideal for some end users. For example, some end users report that the repositionable tab members are difficult to insert. Similarly, some end users report difficulty judging the proper slots into which to insert the tab members in order to obtain the desired positioning. Additionally, the hanging file folder will be without a tab if the repositionable tab member becomes lost or damaged.

Other hanging file folders have been developed to permit selective placement of tab members by providing multiple tab members to a folder, which can be prepositioned for selective extension beyond the edge of the folder. In other words, any of the tab members can be manipulated by the user to cause that tab member to become extended beyond a folder edge, while the other tab members remain hidden so as not to block view of tab members of other folders. An example disclosure of this type of tab member can be found in U.S. Pat. No. 6,732,461. In this patent, the tab member is made of a clear plastic sheet, and the mechanism for holding an extended tab in the extended position is an interlocking rib and groove mechanism. Labeling with this tab member is accomplished by creating a label and inserting it into a plastic sleeve formed of the tab member.

SUMMARY

A hanging file folder having fold-up label features can be comprised of a sheet of flat, foldable material having two doubled over ends. A first hanger member can be disposed within one of the doubled over ends and configured to couple to a hanging file drawer rail. A second hanger member can be disposed within the other of the doubled over ends and configured to couple to the hanging file drawer rail. A plurality of tab members formed of the flat, foldable material can be attached to at least one of the doubled-over ends and have pairs of ears extending to the sides of the tab members. The tab members can be positioned to extend beyond an edge of the doubled over end to which they are attached by folding the tab members and inserting the ears into pairs of slots formed in the doubled over ends.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 16 is a top view of the hanging file folder shown in FIG. 9.

FIG. 17 is a bottom view of the hanging file folder shown in FIG. 9.

Figure 1:
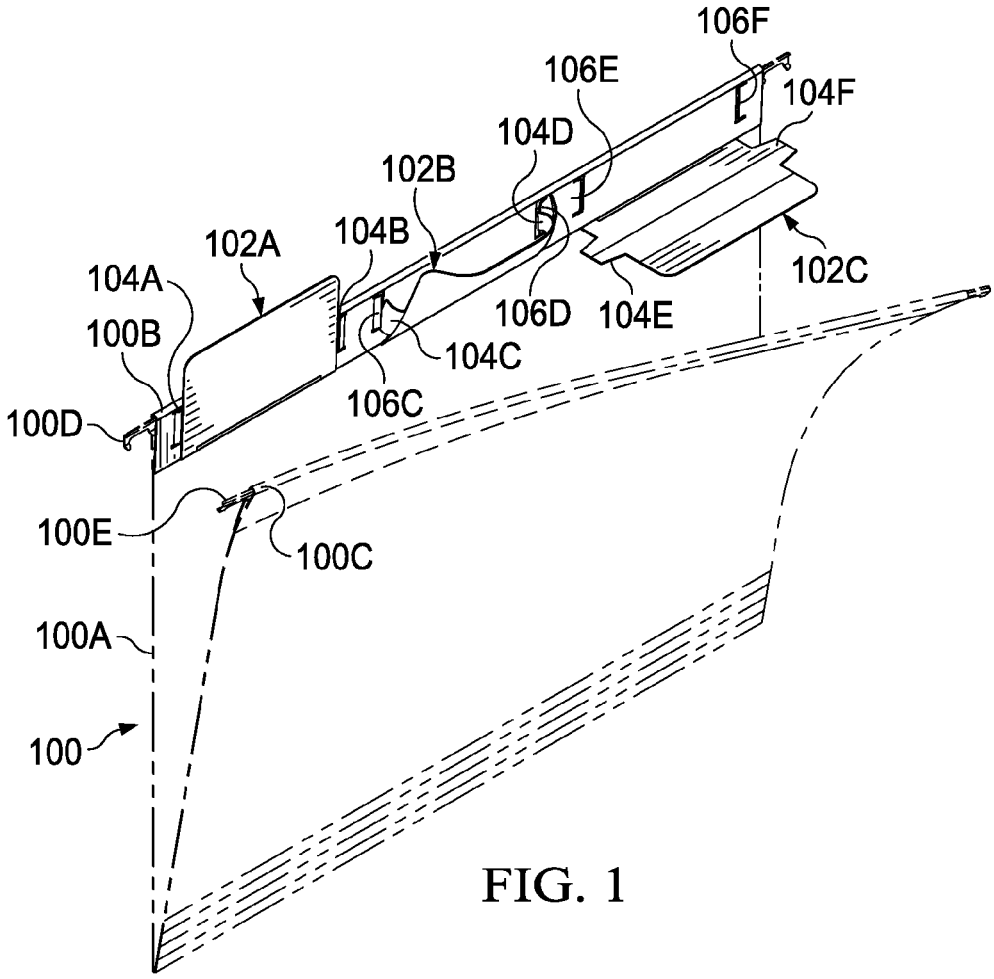
FIG. 1 illustrates a hanging file folder having fold-up labels in accordance with one embodiment of the invention.

For FIGS. 9-17, the dashed and broken lines are for illustrative purposes only, showing the environment, and form no part of the design.

DETAILED DESCRIPTION OF THE INVENTION

It should be understood at the outset that although an exemplary implementation of the present invention is described below, the present invention may be implemented using any number of techniques, whether currently known or in existence. The present invention should in no way be limited to the exemplary implementations, drawings, and techniques described below, including the exemplary design and implementation illustrated and described herein. Like reference numerals refer to like elements throughout the description. Additionally, the drawings contained herein are not necessarily drawn to scale.

With reference now to the figures, and in particular with reference to FIG. 1, an exemplary hanging file folder 100 is shown in which a number, such as three, of fold-up labels are provided. The file folder 100 can be constructed of a jacket 100A made of any suitable material, such as heavy paper or card stock, plastic, or fabric, or for example, 100% recycled materials. The file folder 100 typically has doubled over ends 100B and 100C that may be formed by folding the ends of the jacket over upon themselves and affixing them in place by any suitable means, such as glue or another adhesive. Hanging members 100D and 100E typically are affixed within the double over ends 100B and 100C, respectively, by any suitable means, such as glue or adhesive. Hanging members 100D and 100E, also known as suspension bars, can be configured to couple to hanging file drawer rails, and they can be of any suitable size, shape, and material typically employed for such suspension bars.

In some embodiments, the fold-up labels can be provided by forming tab members 102A-102C made of a flat, foldable material attached to a doubled over edge 100B of the folder 100. In one embodiment, the tab members 102A-102C can be formed of the same flexible material as the jacket 100A for ease of manufacture, and may be integral with the doubled over edge 100B of the file folder 100. It should be understood that, in alternative embodiments, multiple tab members can be provided to one doubled over edge, multiple tab members can be provided to both doubled over edges, or single tab members can be provided to each of the doubled over edges in different, staggered locations. It should also be understood that the tab members may vary in size and shape.

As shown in FIGS. 1 and 2, tab members 102A-102C may each have a pair of ears 104A-104F for insertion in a pair of slots 106A-106F formed in the edge 100B of the hanging file folder 100. As shown more particularly in FIG. 2, in one embodiment, the ears 104A-104F and slots 106A-106F can be positioned generally equidistant from a folding line at or adjacent to a location at which the tab members 102A-102C are attached to the doubled over edge 100B of the folder 100. This choice can ensure a snug fit of the ears 104A-104F into the slots 106A-106F, assist the end user in properly matching the ears 104A-104F to the slots 106A-106F, and effectively eliminate excess tab material that might bulge and tend to resist full closure of the folder 100. However, it should be understood that other arrangements can be implemented, such as longer tab members 102A-102C, ears 104A-104F positioned further along the tab members 102A-102C, with the tab members 102A-102C being folded upon themselves to match the ears 104A-104F to the slots 106A-106F. In this embodiment, a score line or other marking can be added at locations on one or both sides of the tab members 102A-C (see FIG. 2) to assist the end user in matching ears 104A-104F to slots 106A-106F, as well as to assist the user in aligning the label on the tab. In addition, the tab members 102A-102C may contain a score mark along a horizontal axis of such tab member which may serve to provide stress relief to keep the tab member flat.

Still in reference to FIGS. 1 and 2, in one embodiment, the slots 106A-F may be generally adapted to hold ears 104A-F in place after such ears are inserted into slots 106A-F (see FIG. 1). The slots 106A-F generally may contain an elongated portion and one or more smaller portions, as best shown in FIG. 1 (106E, 106F). The slots 106A-F are formed in the doubled-over end 100B, the elongated portion of the slot being generally substantially perpendicular to the hanging members 100D and 100E, and the one or more smaller portions are substantially parallel to the hanging members 100D and 100E and extend from the elongated portion, as shown. Such slot configuration in the doubled-over end 100B yields a rigid yet flexible barrier which serves both to hold the ears 104A-F, and in turn, tab members 102A-C, in the extended position, but yet is flexible enough such that the user may easily remove the tab member from the slots in order to place the tab member in a pre-extended position. It should be understood that the slots 106A-F which may be formed in the material of the doubled-over end 100B of the hanging file lie in a different horizontal plane than the hanger members 100D and 100E.

In one embodiment, the ears 104A-104F can have flat edges and can become narrower in a direction extending away from the tab member. The narrowing of the ears 104A-104F can reduce the degree to which the end user must bend tab members 102A-102C when inserting the ears 104A-104F into the slots 106A-106F, especially when the ears 104A-104F and slots 106A-106F are positioned generally equidistant from a folding line at or adjacent to a location at which the tab members 102A-102C are attached to the doubled over edge 100B of the folder 100. However, it should be understood that the ears 104A-104F can have other shapes in alternative embodiments. For example, rounded or square ears might be employed.

Figure 2A:
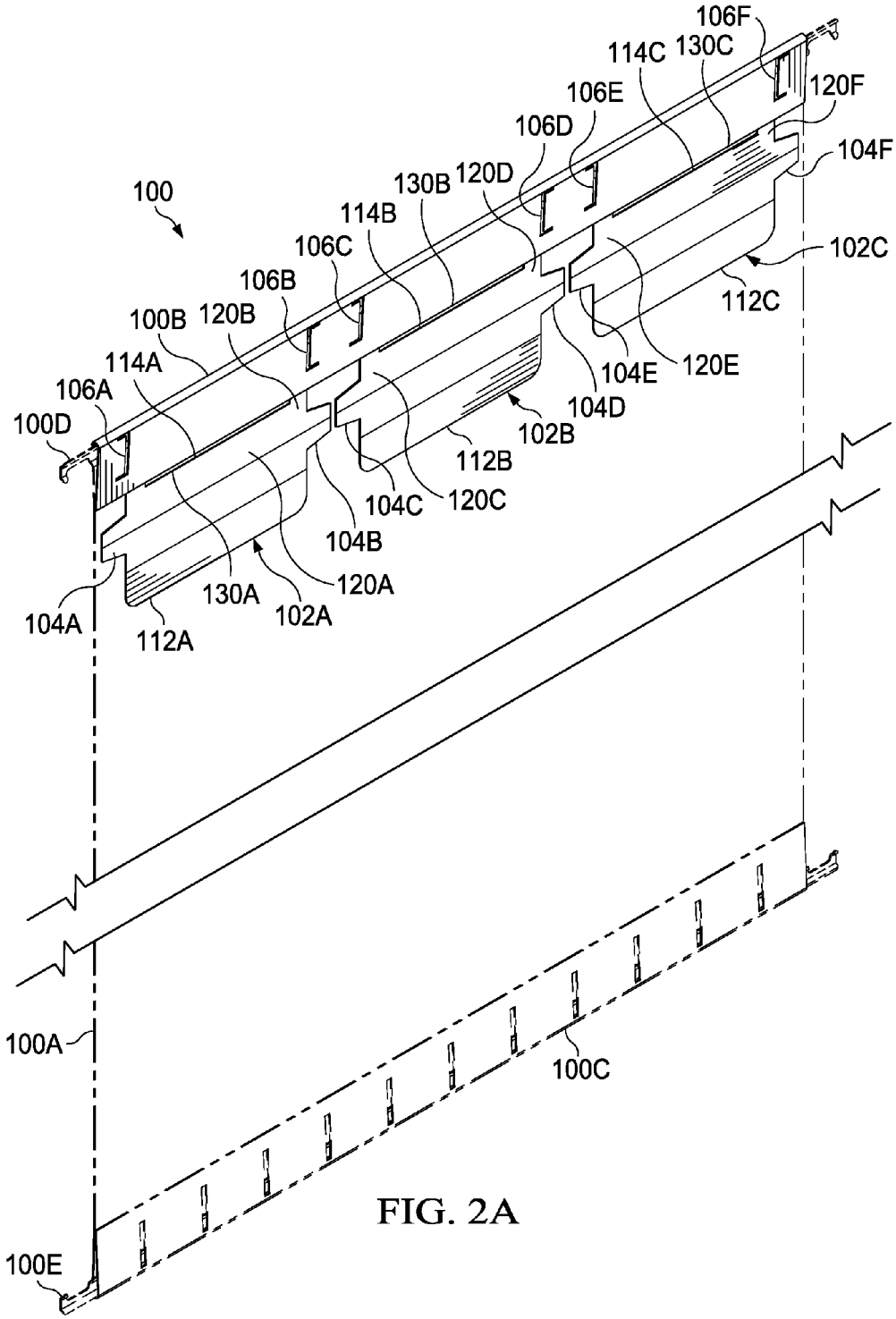
FIG. 2*a* illustrates an open hanging file folder having fold-up labels in a pre-extended position.
Figure 2B:
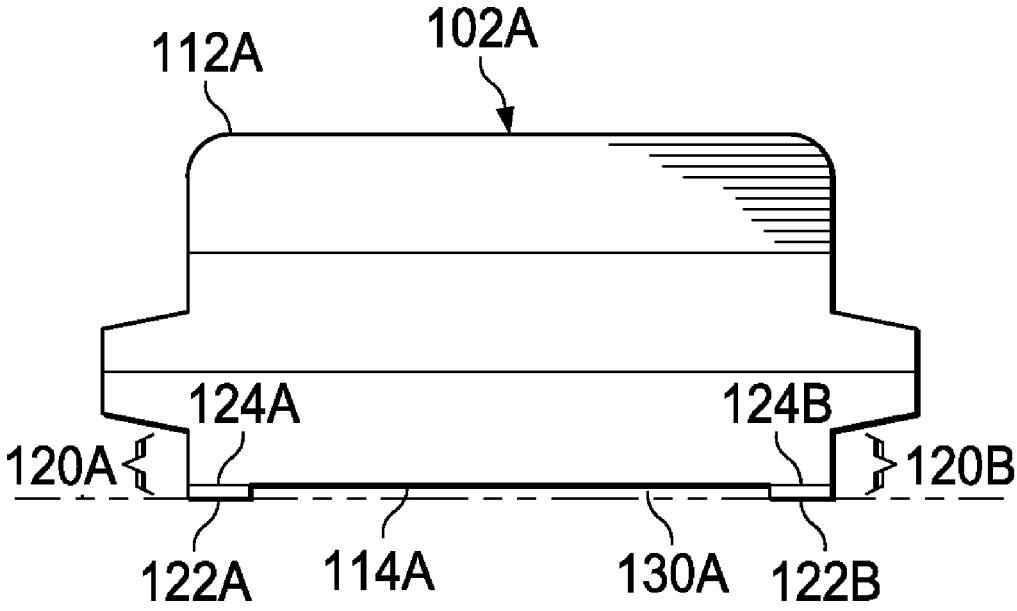
FIG. 2*b* is an expanded view of one of the fold-up labels shown in FIG. 2*a*.

As shown, in particular, in FIG. 2, the tab members 102A-C may be attached to the file folder at various locations. In one embodiment, tab members 102A-C may be attached at multiple, different locations, which may be equidistant to one another. FIG. 2*b* is an expanded view of tab member 102A illustrates additional characteristics of tab members of the present invention. As shown in FIGS. 2 and 2*b*, for example, tab members 102A-C generally may be characterized as each having a top end 112A-C and a bottom end 114A-C. In one embodiment, tab members 102A-C may be attached to the file folder utilizing hinge elements 120A-F. Hinge elements 120A-F generally may be formed of the same material as tab members 102A-C and serve to connect tab members 102A-C to the file folder 100. Generally, as shown more particularly in FIG. 2A (referencing specifically tab member 102A as an example), hinge members 120A-F may have a first end 122A-F and a second end 124A-F, the first end 122A-F being attached to an edge of the doubled over end 100B, or other portion of the file folder 100, and the second end 124A-F may be attached at the bottom end of the tab member 102A-F.

It will be recognized that the number of hinge members 120A-F may vary. In one embodiment, two hinges may be employed equidistant to one another. As best illustrated in FIG. 2*a*, the placement of the hinge members 120A-F may form an elongated "gap" 130A-C between hinge members 120A-F. This "gap" may be defined horizontally by the position of the hinge members 120A-F and may be defined vertically by the bottom end of the tab member (114A-C) and the point of attachment to the file folder. This configuration generally may relieve stress and keep the tab member flat and prevent bowing, both in the pre-extended and extended positions of the tab members.

Figure 3:
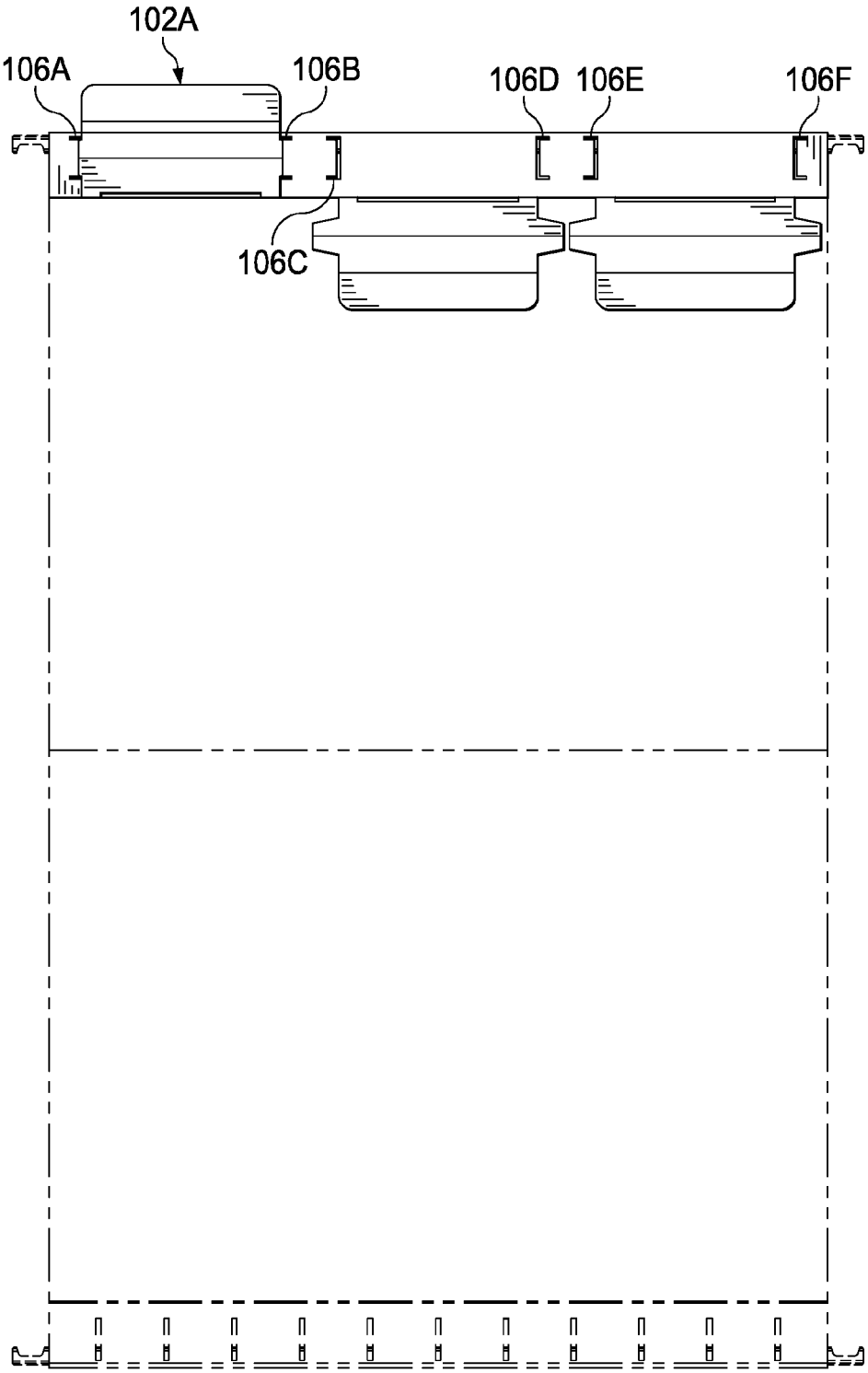
FIG. 3 illustrates the hanging file folder of FIG. 2 in which one of the fold-up labels has been selectively extended.

As indicated in FIG. 3, a user may fold all three tab members into an extended position. Alternatively, a user may extend only one of the tab members on a folder, such as tab member 102A. By extending folding tab member 102A at its natural folding point and inserting its ears into slots 106A and 106B, a snug fit can be achieved that retains the tab member 102A in an extended position.

Figure 4:
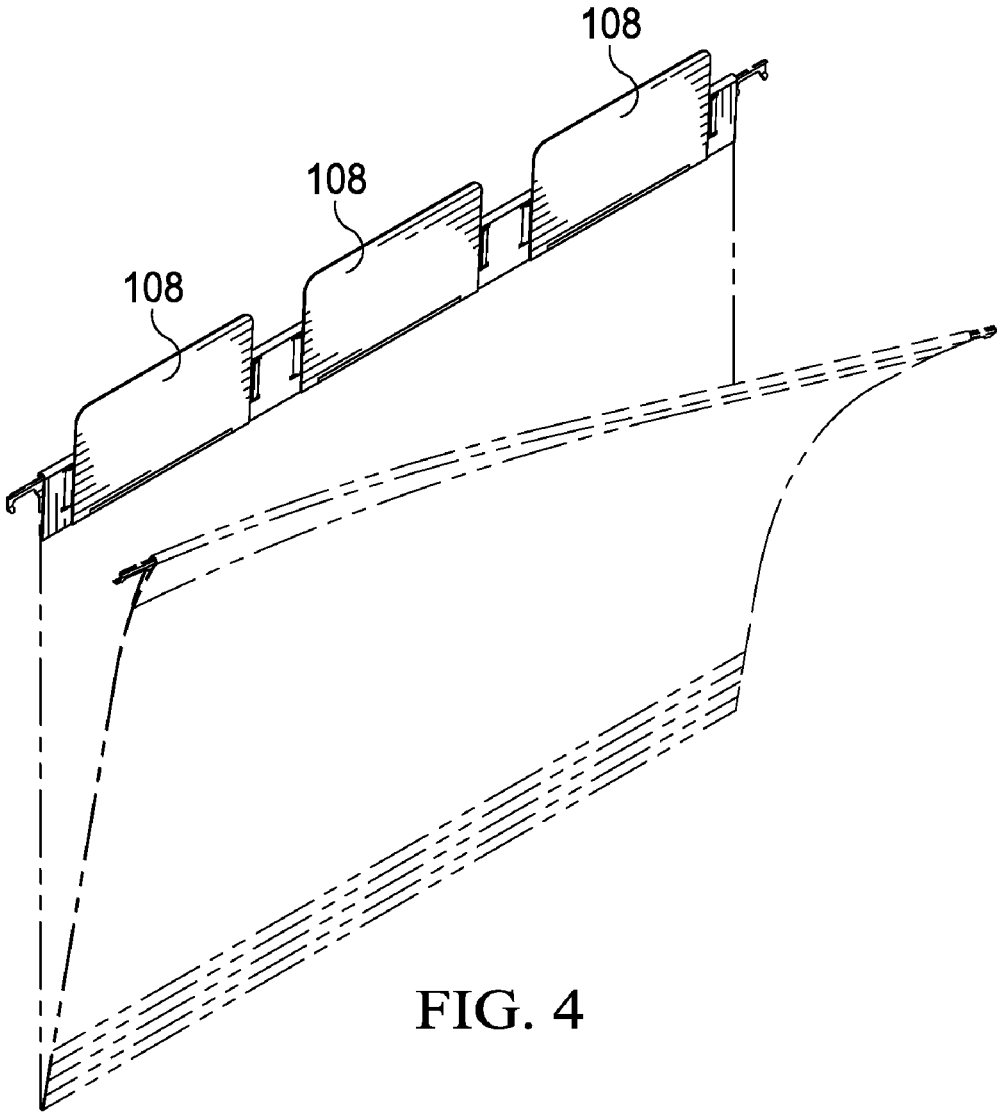
FIG. 4 illustrates the hanging file folder of FIG. 2 having fold-up labels in an extended position.
Figure 5:
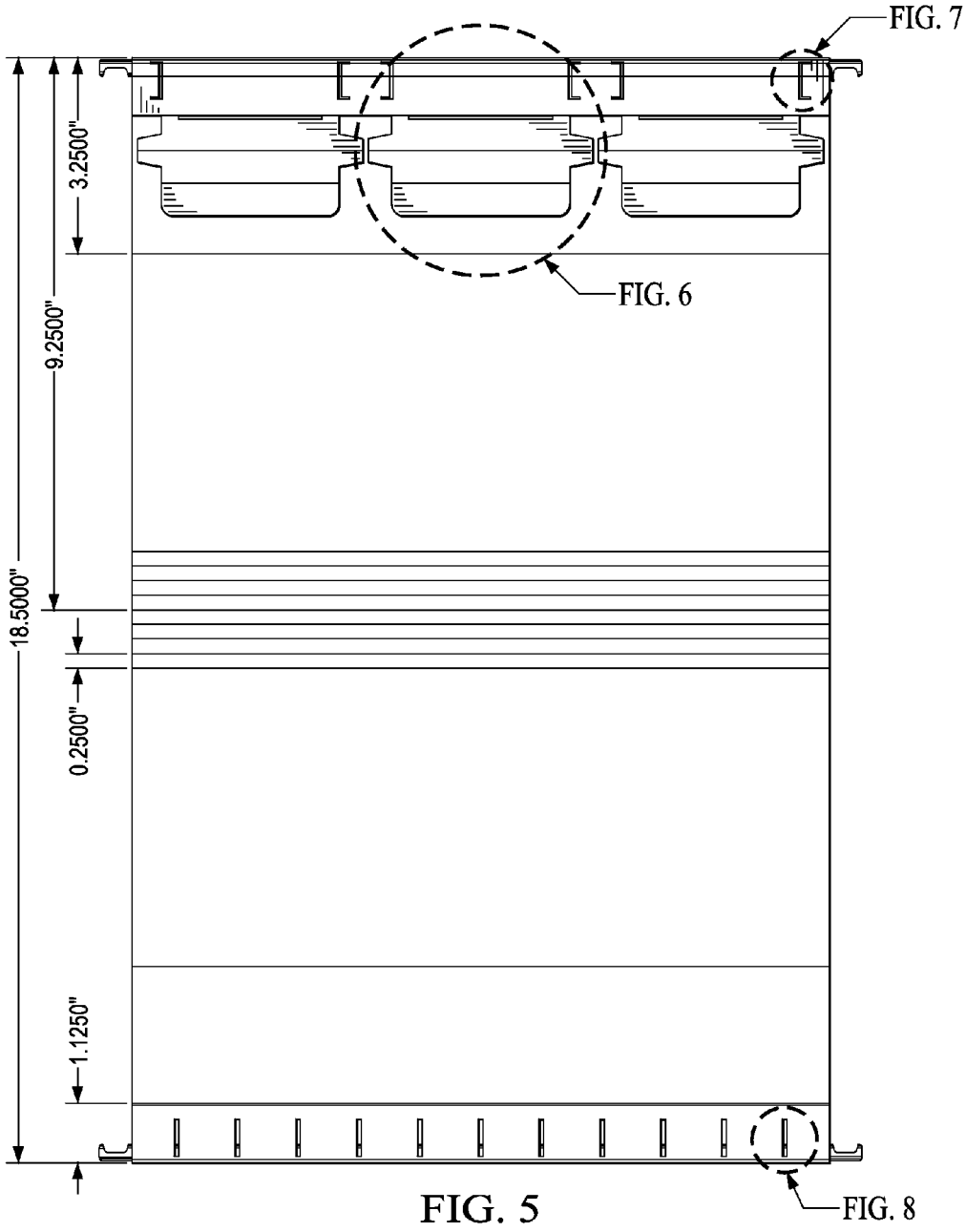
FIG. 5 is a drawing illustrating various aspects of the file folder of FIGS. 1-4, such folder capable of being formed from a single sheet of paper material (such as 100% recycled paper). In the figure, dashed lines represent score lines and wherein measurements are in inches.
Figure 6:
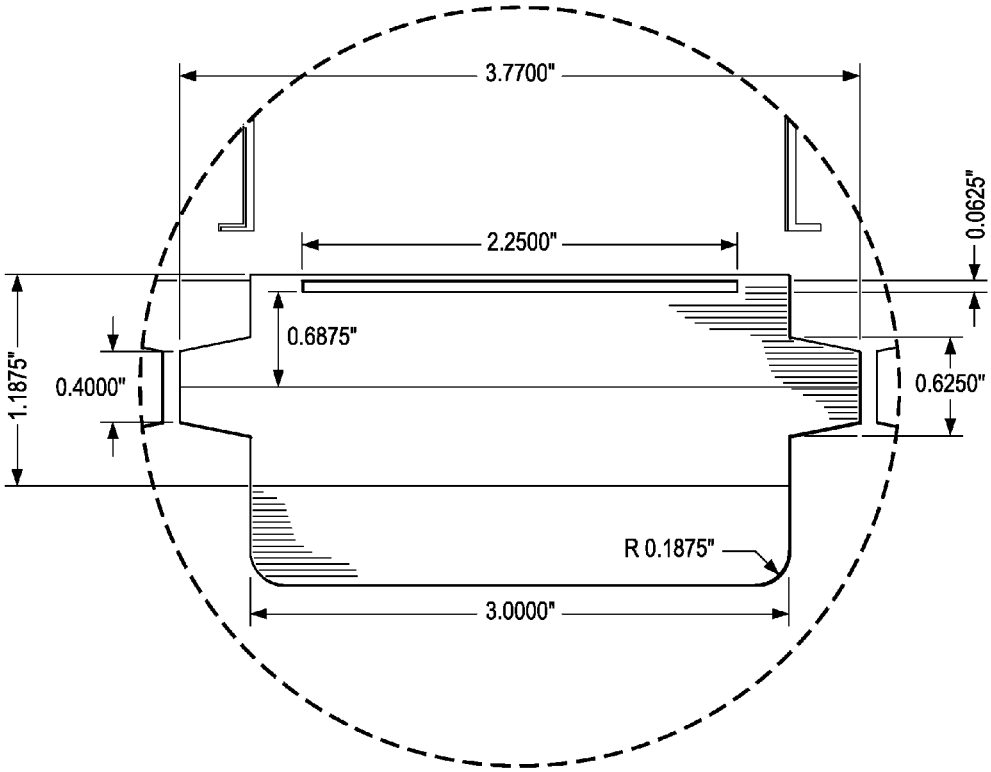
FIG. 6 illustrates a folder portion (Detail A) of the drawing of FIG. 5 in greater detail.
Figure 7:
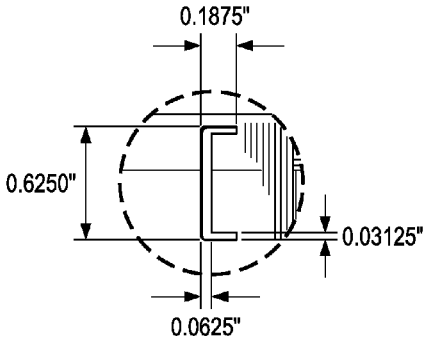
FIG. 7 illustrates a folder portion (Detail B) of the drawing of FIG. 5 in greater detail.
Figure 8:
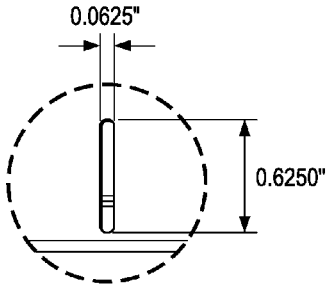
FIG. 8 illustrates a folder portion (Detail C) of the drawing of FIG. 5 in greater detail.

Turning now to FIG. 4, extending the tab member yields a labeling surface 108. The end user can label the folder in various ways, such as by writing directly on the labeling surface 108, or by writing on an adhesive label and placing the adhesive label on the labeling surface 108. The tab member may be formed from heavy paper or card stock for ease of use.

By alternating which of the tab members is extended on different folders in this manner, the visible labeling surfaces can be staggered as desired. If relabeling is desired, the end user can choose to repurpose the folder by extending a different tab member and writing directly on the new labeling surface. Alternatively or additionally, the end user can place a new adhesive label over an old label while employing the same tab member.

FIGS. 5-8 show how hanging file folder 100 may be cut from a sheet material, such as heavy paper or card stock. Of course, the dimensions shown in FIGS. 5-8 are for illustrative purposes only, and the present invention is in no way limited to such dimensions. Utilizing this construction method, formation of the folder can be accomplished by folding ends of a jacket cut from the sheet over hanger members. Adhesive can be utilized to secure the hanger members and the doubled over ends in place. The tab members are thus placed in a non-extended position and prepared for use. Adhesive is generally not applied to the tab members, nor utilized near the slots so as to permit a pocket into which the ears can be inserted.

Figure 9:
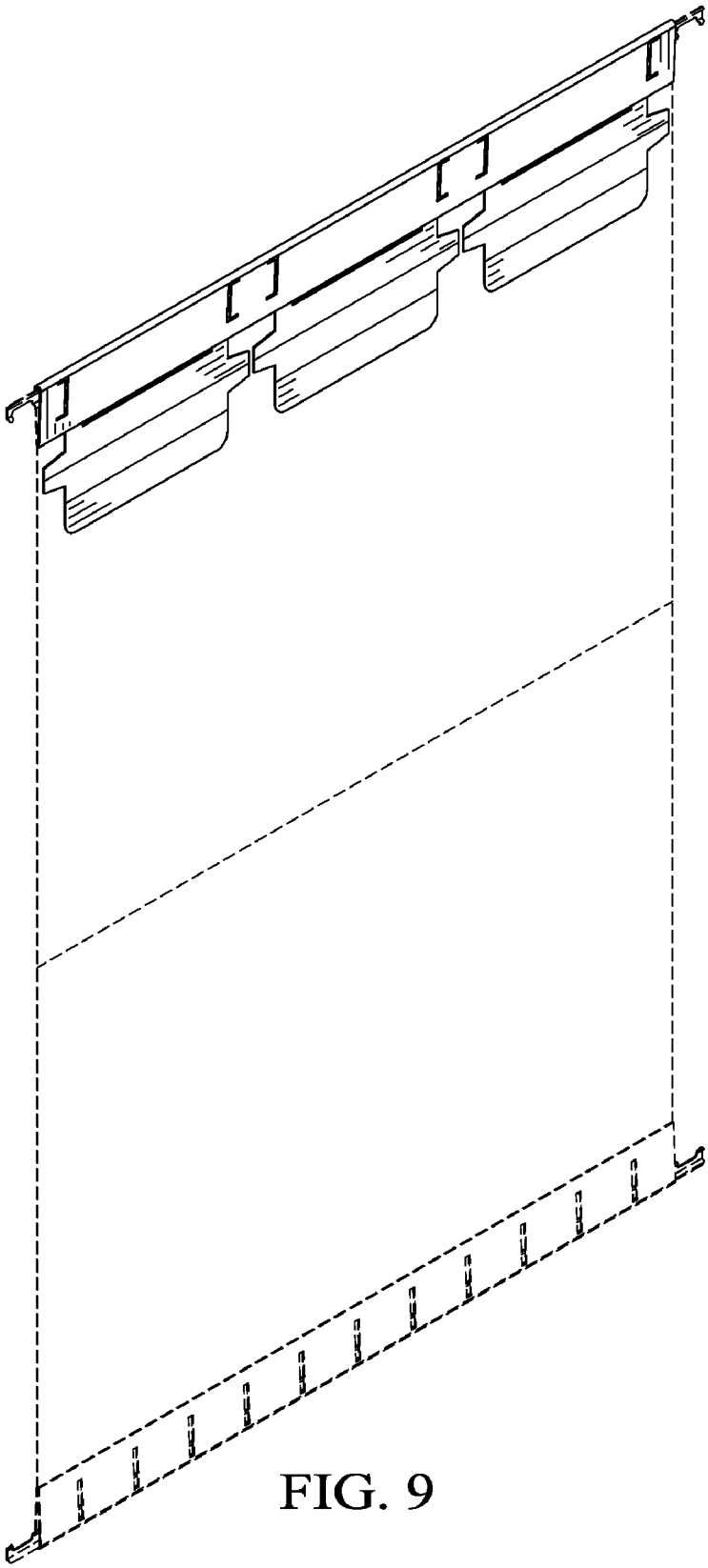
FIG. 9 is a front perspective view of a design for a hanging file folder having fold-up label features, illustrating, in particular, fold-up labels in a pre-extended position.
Figure 10:
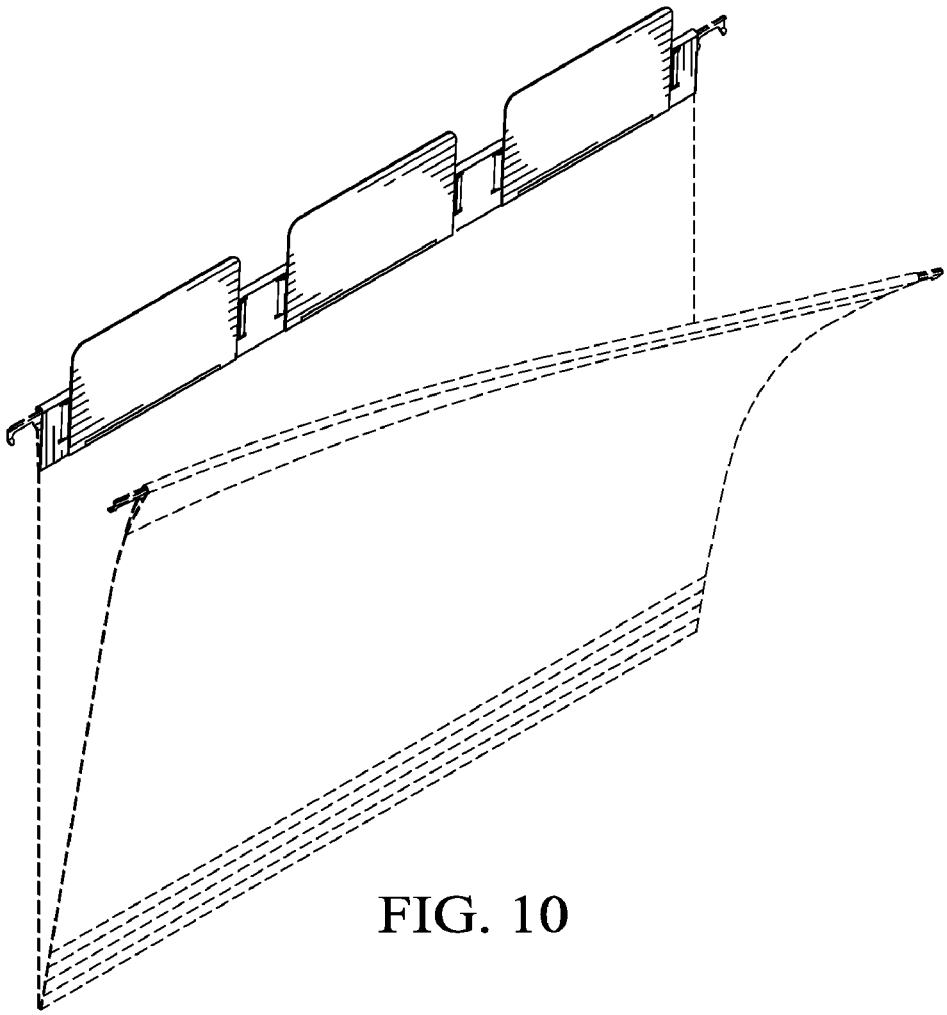
FIG. 10 is an additional perspective view of the design shown in FIG. 9, illustrating in particular fold-up labels in an extended position.
Figure 11:
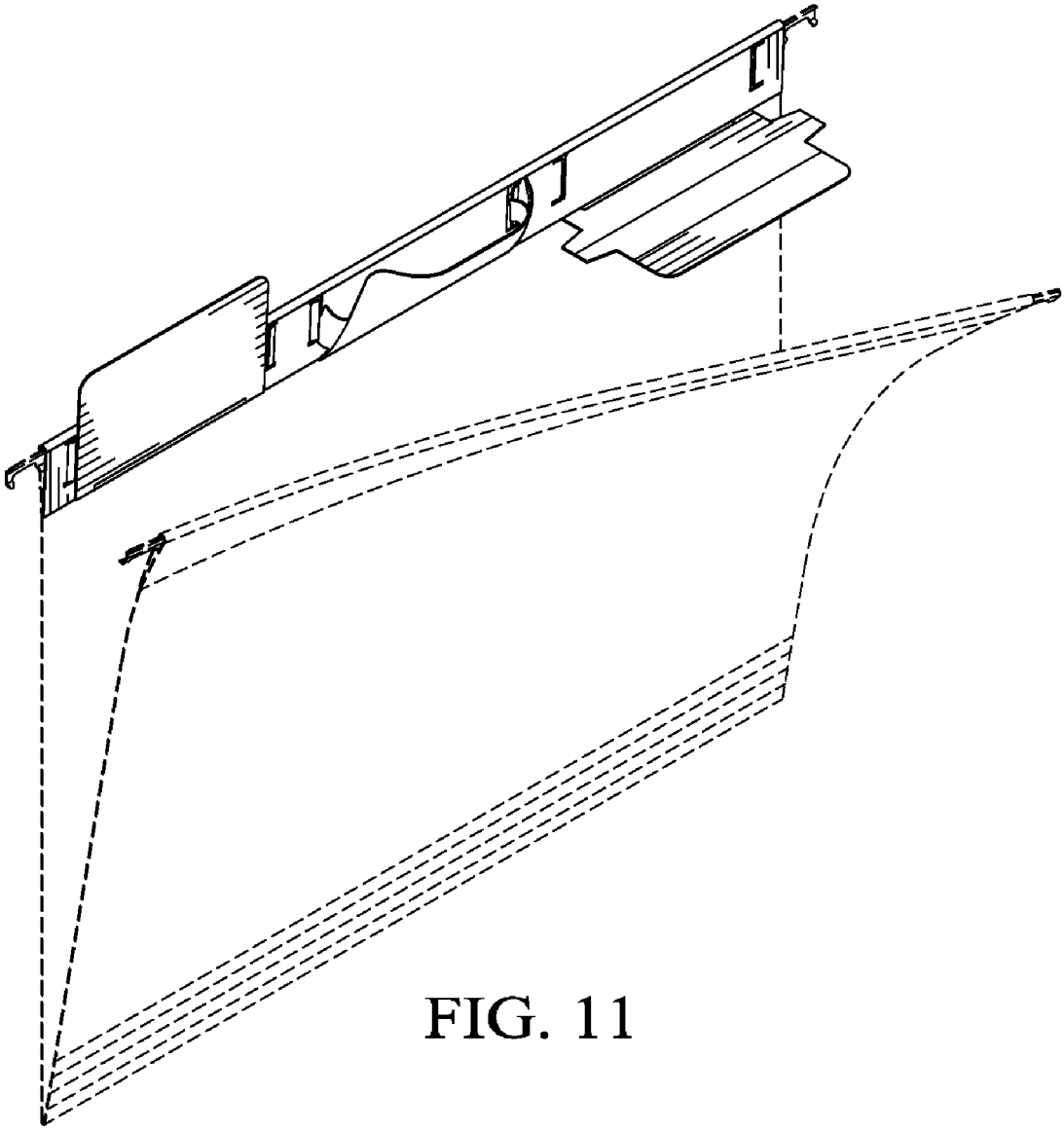
FIG. 11 is yet a further perspective view of the design shown in FIG. 9, illustrating in particular fold-up labels in both pre-extended and extended positions.
Figure 12:
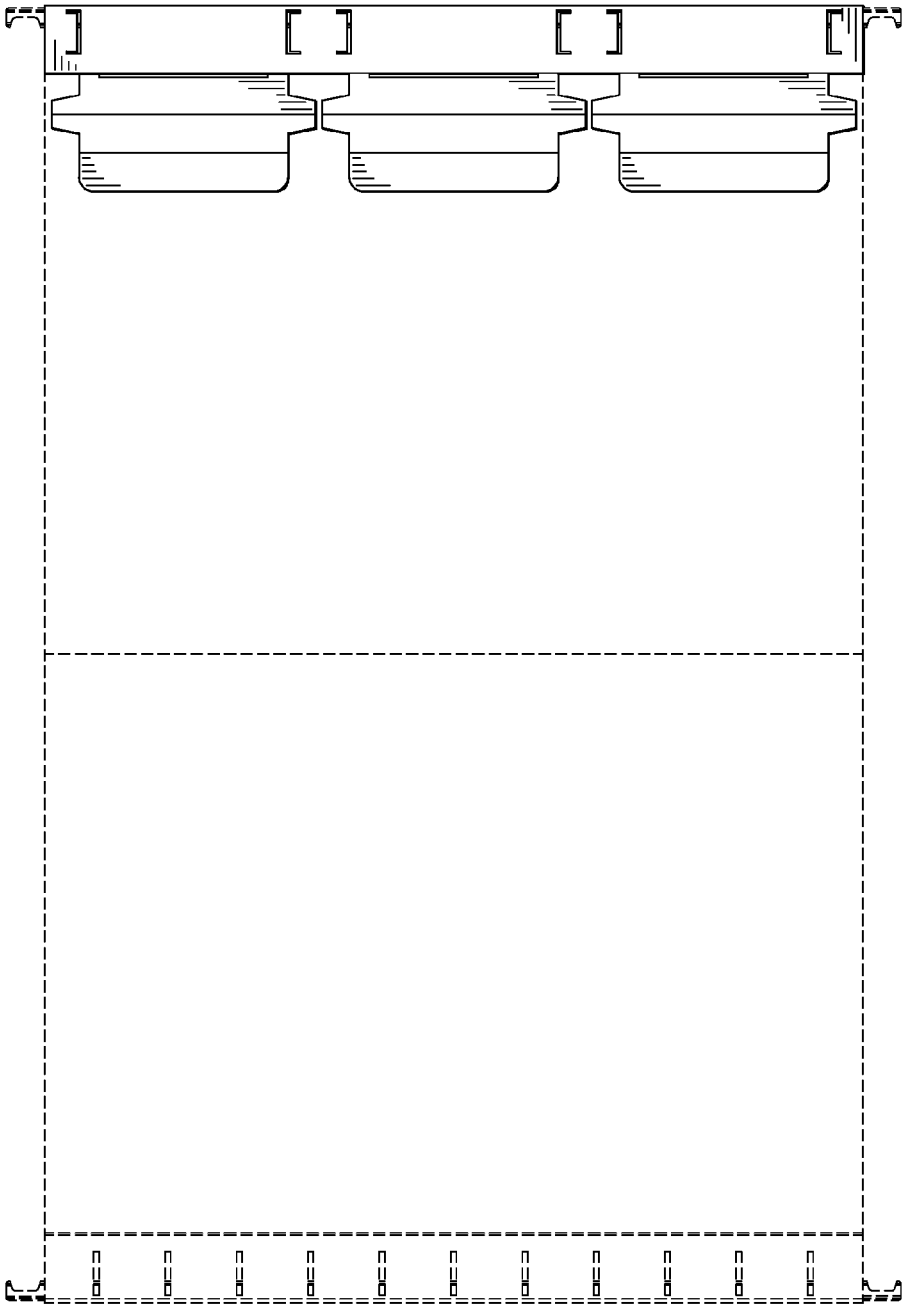
FIG. 12 is a front elevation view of the hanging file folder shown in FIG. 9.
Figure 13:
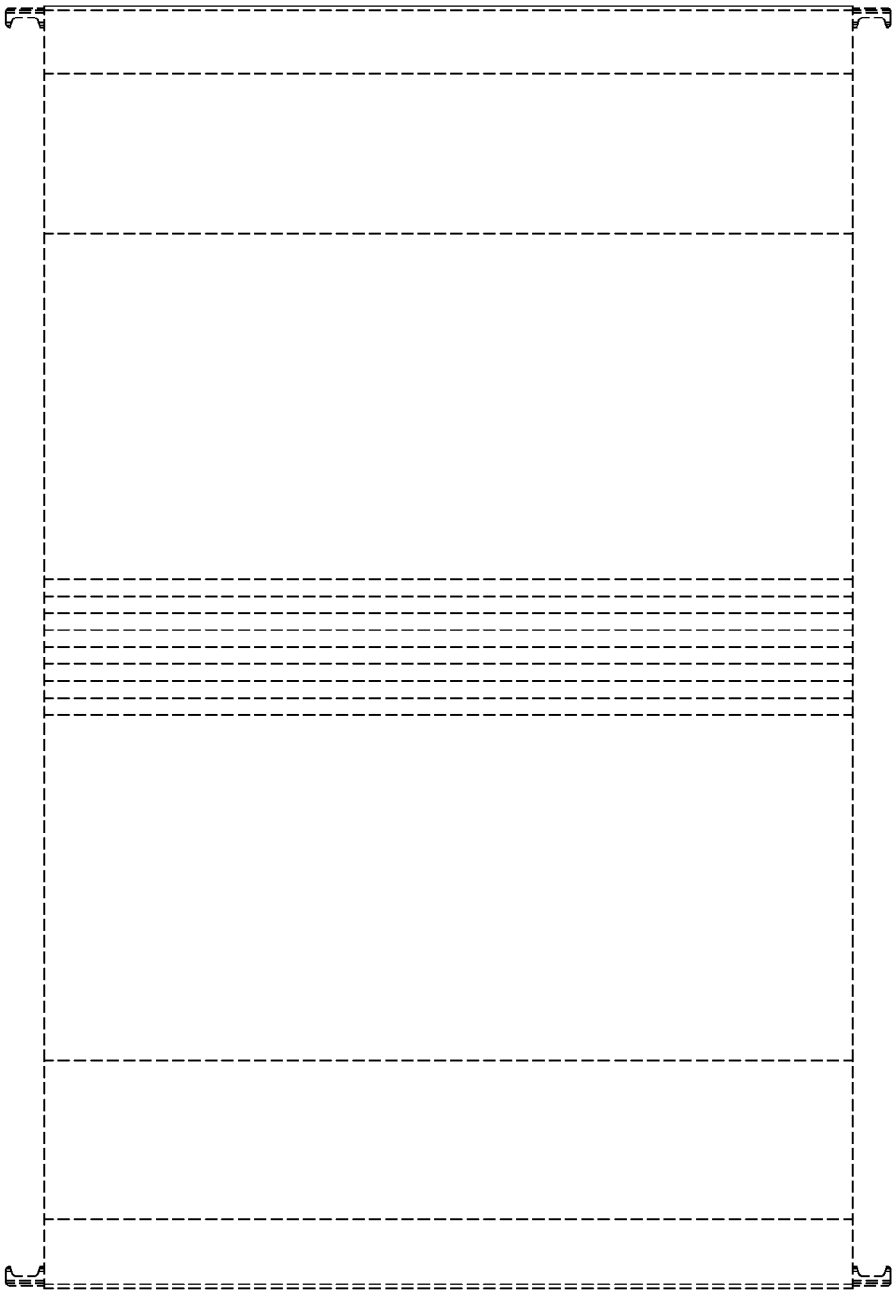
FIG. 13 is a rear elevation view of the hanging file folder shown in FIG. 9.
Figure 14:
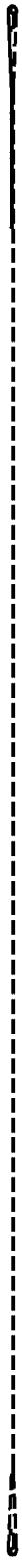
FIG. 14 is a right side elevation view of the hanging file folder shown in FIG. 9.
Figure 15:
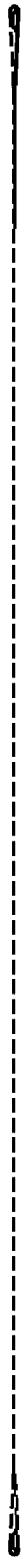
FIG. 15 is a left side view of the hanging file folder shown in FIG. 9.

FIGS. 9-17 illustrate an ornamental design for a hanging file folder having fold-up label features. FIG. 9 is a front perspective view of such ornamental design, illustrating, in particular, fold-up labels in a pre-extended position. FIG. 10 is an additional perspective view of such ornamental design illustrating in particular fold-up labels in an extended position. FIG. 11 is yet a further perspective view of such ornamental design illustrating in particular fold-up labels in both pre-extended and extended positions. FIG. 12 is a front elevation view of the hanging file folder shown in FIG. 9. FIG. 13 is a rear elevation view of the hanging file folder shown in FIG. 9. FIG. 14 is a right side elevation view of the hanging file folder shown in FIG. 9. FIG. 15 is a left side view of the hanging file folder shown in FIG. 9. FIG. 16 is a top view of the hanging file folder shown in FIG. 9. FIG. 17 is a bottom view of the hanging file folder shown in FIG. 9.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A hanging file folder having fold-up label features, the folder comprising:

a sheet of flat, foldable material having two doubled over ends;

a first hanger member disposed within one of the doubled over ends and configured to couple to a hanging file drawer rail;

a second hanger member disposed within the other of the doubled over ends and configured to couple to the hanging file drawer rail;

a tab member formed of the flat, foldable material attached to at least one of the doubled-over ends at an edge thereof and having pairs of ears extending to the sides thereof, wherein said tab member is positioned to be extended beyond a top folded edge of said doubled over end to which it is attached by folding the tab member and inserting the ears into pairs of slots formed in the doubled-over end to which it is attached.

2. The hanging file folder of claim 1, wherein the ears and slots are positioned equidistant from a natural folding line of said tab member that is a location at which said tab member is attached to the doubled over end.

3. The hanging file folder of claim 2, wherein the ears have flat edges and become narrower in a direction extending away from the tab member to which they are attached.

4. The hanging file folder of claim 1, wherein said slots are adapted to hold said ears in place upon insertion in said slots.

5. The hanging file folder of claim 1, wherein the slots each comprise an elongated portion and one or more smaller portions, each of which is formed in the doubled-over end, wherein the elongated portion is perpendicular to the first hanger member, and the one or more smaller portions are substantially parallel to the first hanger member and extend from the elongated portion.

6. The hanging file folder of claim 1, wherein said tab member is attached to at least one of the doubled-over ends at different locations along said doubled-over end.

7. The hanging file folder of claim 6, wherein said locations are equidistant from each other.

8. The hanging file folder of claim 1, wherein said tab member comprises a top end and a bottom end and is attached to at least one of the doubled-over ends by means of a hinge.

9. The hanging file folder of claim 8, wherein the hinge has a first end and a second end, the first end being attached to the at least one doubled-over end of the hanging file folder, and the second end being attached to the bottom end of the tab member.

10. The hanging file folder of claim 1, wherein said tab member is attached to the at least one doubled-over end of the hanging file folder by means of two hinges equidistant from one another, wherein the two hinges form an elongated gap between the hinges, said gap being defined horizontally by the position of the two respective hinges, and being defined vertically by the bottom end of the tab member and the doubled-over end.

11. The hanging file folder of claim 8, wherein the hinge relieves stress and keeps the tab member flat and prevents bowing of the tab member in an extended position.

12. The hanging file folder of claim 1, wherein the slots and the first hanger member are in different horizontal planes from one another.

13. The hanging file folder of claim 1, wherein said tab member and said sheet of flat, foldable material are formed of one sheet, such that said tab member is integral with the doubled over edge of the file folder.

14. The file folder of claim 1, wherein the flat, foldable material is at least one of a heavy paper or card stock.

15. The file folder of claim 1, wherein the flat, foldable material is recycled paper.

16. The hanging file folder of claim 1, wherein the ears have flat edges and become narrower in a direction extending away from the tab member to which they are attached.

17. The hanging file folder of claim 1, comprising a plurality of tab members wherein one of said tab members is attached to one of the doubled over ends in different, staggered locations than another of said tab members attached to another of the doubled over ends.

18. The hanging file folder of claim 1, wherein said tab member is attached to only one of the doubled over ends.

19. The hanging file folder of claim 1, wherein the tab member has at least one of a score line or another marking indicating a folding line for matching the ears to the slots.

20. The hanging file folder of claim 1, wherein the tab member has a stress relief score mark along a horizontal axis of the tab member.

21. The hanging file folder of claim 1, wherein the tab member in either a pre-extended or extended position lies flat and does not bow.

22. The hanging file folder of claim 1, wherein the ears have at least one of a square shape or a round shape.

23. The hanging file folder of claim 16, wherein the two flat edges of the ear opposite one another and extending away from the fold up label are angled at least with respect to one another to close the distance therebetween and effectively narrow the ear in the direction extending away from the tab member.

24. The hanging file folder of claim 5, wherein the smaller portions extend from the elongated portion in a direction away from the tab member the slot is adapted to receive.

* * * * *